US007021283B2

(12) United States Patent
Okuyama

(10) Patent No.: US 7,021,283 B2
(45) Date of Patent: Apr. 4, 2006

(54) CONTROL DEVICE FOR ENGINE OF BOAT

(75) Inventor: Takashi Okuyama, Hamamatsu (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 0 days.

(21) Appl. No.: 10/978,275

(22) Filed: Oct. 29, 2004

(65) Prior Publication Data

US 2005/0284446 A1 Dec. 29, 2005

(30) Foreign Application Priority Data

Jun. 28, 2004 (JP) ..... 2004-189640

(51) Int. Cl.
*F02D 41/14* (2006.01)
*B63H 21/38* (2006.01)

(52) U.S. Cl. ..... 123/350; 12/361; 440/88

(58) Field of Classification Search ..... 123/350, 123/352, 361, 396, 399; 318/254, 727; 477/107, 477/108, 111; 440/84, 87, 88
See application file for complete search history.

(56) References Cited

U.S. PATENT DOCUMENTS 5,477,826 A * 12/1995 Hara et al. ..... 123/399
5,828,193 A * 10/1998 Furuta ..... 123/399
6,017,290 A * 1/2000 Kinoshita et al. ..... 477/108
6,067,960 A * 5/2000 Watanabe et al. ..... 123/399
6,250,282 B1 * 6/2001 Osaki et al. ..... 123/352
6,428,448 B1 * 8/2002 Saito et al. ..... 477/111
6,465,974 B1 * 10/2002 Watanabe ..... 318/254
2001/0019252 A1 * 9/2001 Watanabe ..... 318/727

FOREIGN PATENT DOCUMENTS

JP 58-62334 A * 4/1983
JP 08-296473 11/1996
JP 2003-214220 A * 7/2003

* cited by examiner

*Primary Examiner*—Willis R. Wolfe, Jr.
(74) *Attorney, Agent, or Firm*—Knobbe, Martens, Olson & Bear, LLP

(57) ABSTRACT

A throttle opening command value setting device for setting a throttle opening command value, a throttle control device for controlling a throttle valve of an engine based on a throttle opening command value set by the throttle opening command value setting means, and an engine speed detecting device for detecting the engine speed of the engine are provided. The throttle control device learns and controls the throttle opening based on the deviation of the throttle opening command value set by the throttle opening command value setting device from a target throttle opening corresponding to the engine speed detected by the engine speed detecting device.

8 Claims, 16 Drawing Sheets

CONTROL DEVICE FOR ENGINE OF BOAT

The present application is based on and claims priority under 35 U.S.C. § 119 Japanese Patent Application No. 2004-189640, filed on Jun. 28, 2004, the entire contents of which are expressly incorporated by reference herein.

BACKGROUND OF THE INVENTIONS

1. Field of the Inventions

The present inventions relate to control devices for engines of boats, and more particularly, to control devices that provide enhanced vessel speed control.

2. Description of the Related Art

Modern boats are typically provided with a power request device disposed in the operator's area, which is also known as a cockpit. The power request device can be constructed in various ways (e.g., a pedal), but is typically in the form of a lever. Often, such a lever is connected to the engine of the boat with a plurality of cables for controlling both the power output of the engine, and where the boat has neutral and/or reverse gears, the gear position.

Recently, marine propulsion system manufacturers have adapted digital communication network systems for connecting various components of such propulsion systems. In these networks, user controls and gauges, such as throttle levers and tachometers, can be connected to the associated engine through a digital network. These networks simplify the electrical wiring needed for such a boat and also provide great flexibility.

In these systems, a throttle lever, for example, will include a sensor which converts a physical position of the lever into an electronic signal. The electronic signal can than be transmitted to the engine directly, or over a digital communication network. Additionally, although a particular gauge or input device is connected to the engine with a hard wire, or through a digital communication network, the gauge or input device can also be mechanically connected to the engine to provide control if the network is not used or is inoperable.

Where a boat uses an electronically enabled control, such as a throttle or "control" lever, an electric signal corresponding to a position, or an angle, of a control lever (displacement) is transmitted to a control section in the engine controller of the engine. The control section controls a throttle actuating unit for actuating a throttle valve of the engine incorporated in an outboard motor, for example, to control the engine speed. The desired position of the throttle valve is determined based on the displacement of the control lever with reference to a "map" in which the relation between the displacement of the control lever and the desired throttle valve opening is stored. A throttle actuating unit is operated so that the throttle valve is moved to the desired position.

In at least one known system, when the throttle valve does not reach the set position within a predetermined period of time, the relation between the displacement and the actuating amount stored in the map is corrected (see e.g. Japanese Patent Publication Hei 8-296473 (pp. 1 to 2 and FIG. 3)).

SUMMARY OF THE INVENTION

In the device disclosed in Japanese Patent Publication Hei 8-296473, the control lever position and the corresponding predetermined throttle valve position can be precisely associated with each other. However, outboard motors are often produced separately from hulls and can be mounted on various types of hulls having different resistance properties. These differences result in different acceleration characteristics, among other performance differences. Thus, there remains a problem that it is difficult to maintain the displacement output from the remote control lever and the engine speed in a specific relation.

The present inventions have been made in view of the unsolved problem of the conventional device, and it is, therefore, an object of the present invention to provide a control device for an engine of a boat which can provide enhanced speed control even for boats having different resistance characteristics of their hulls.

In accordance with one embodiment, a control device for an engine of a boat comprises a throttle opening command value setting module configured to set a throttle opening command value. A throttle control module is configured to control a throttle valve of the engine based on a throttle opening command value set by the throttle opening command value setting module. An engine speed detecting device is configured to detect the engine speed of the engine. The throttle control module is configured to learn and control the throttle opening based on the deviation of the throttle opening command value set by the throttle opening command value setting module from a target throttle opening corresponding to the engine speed detected by the engine speed detecting device.

In accordance with another embodiment, a control device for an engine of a boat comprises throttle opening command value setting means for setting a throttle opening command value. The control device also includes throttle control means for controlling a throttle valve of the engine based on a throttle opening command value set by the throttle opening command value setting means. Engine speed detecting means are included for detecting the engine speed of the engine. The throttle control means learns and controls the throttle opening based on the deviation of the throttle opening command value set by the throttle opening command value setting means from a target throttle opening corresponding to the engine speed detected by the engine speed detecting means.

BRIEF DESCRIPTION OF THE DRAWINGS

The above-mentioned and other features of the inventions disclosed herein are described below with reference to the drawings of the preferred embodiments. The illustrated embodiments are intended to illustrate, but not to limit the inventions. The drawings contain the following Figures.

DETAILED DESCRIPTION OF THE PREFERRED EMBODIMENT

Figure 1:
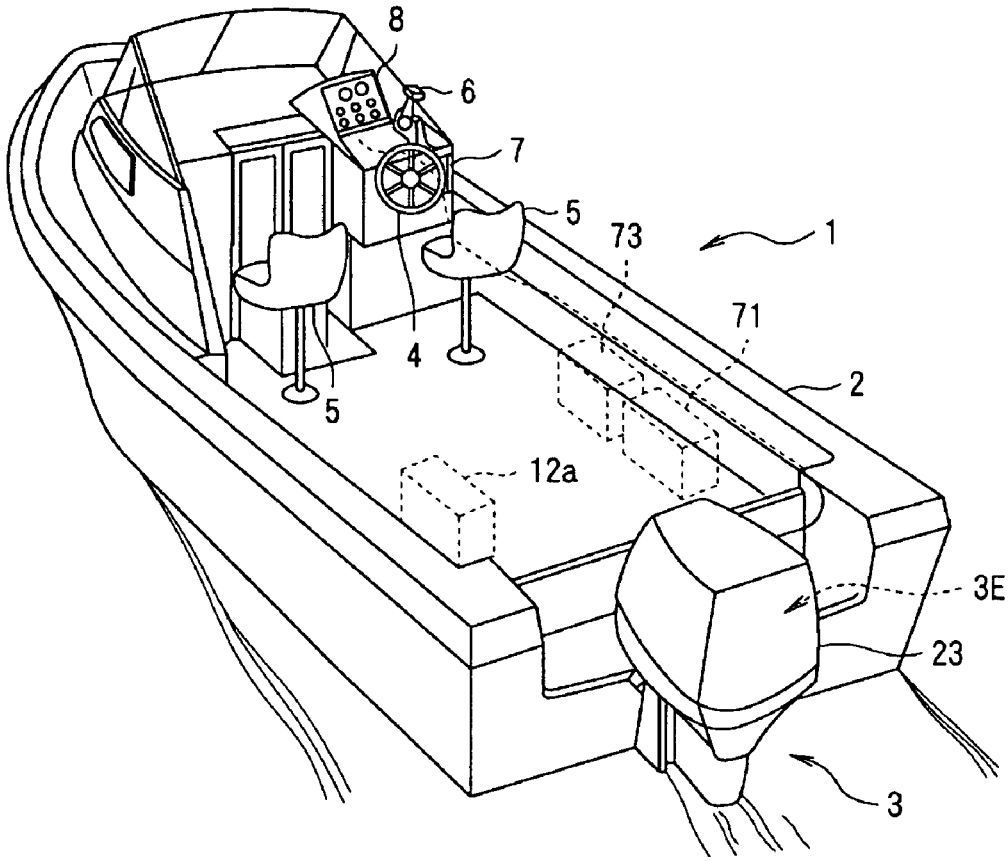
FIG. 1 is a schematic perspective view of a boat powered by an outboard-type marine propulsion system constructed in accordance with an embodiment.

FIG. 1 is a schematic structural view of a marine propulsion system included on a small boat 1. The embodiments disclosed herein are described in the context of a marine propulsion system of a small boat because these embodiments have particular utility in this context. However, the embodiments and inventions herein can also be applied to other marine vessels, such as personal watercraft and small jet boats, as well as other vehicles.

In FIG. 1, reference numeral 1 denotes a small boat such as a powerboat. The small boat 1 has an open deck type hull 2, an outboard motor 3 mounted on a rear part of the hull 2, although other types of boats can also be used. A cockpit having a steering wheel 4, seats 5, a remote control lever 6 a switch panel 7 with a main switch and a start switch, a meter panel 8 and so on which are disposed at a front part of the hull 2.

Figure 2:
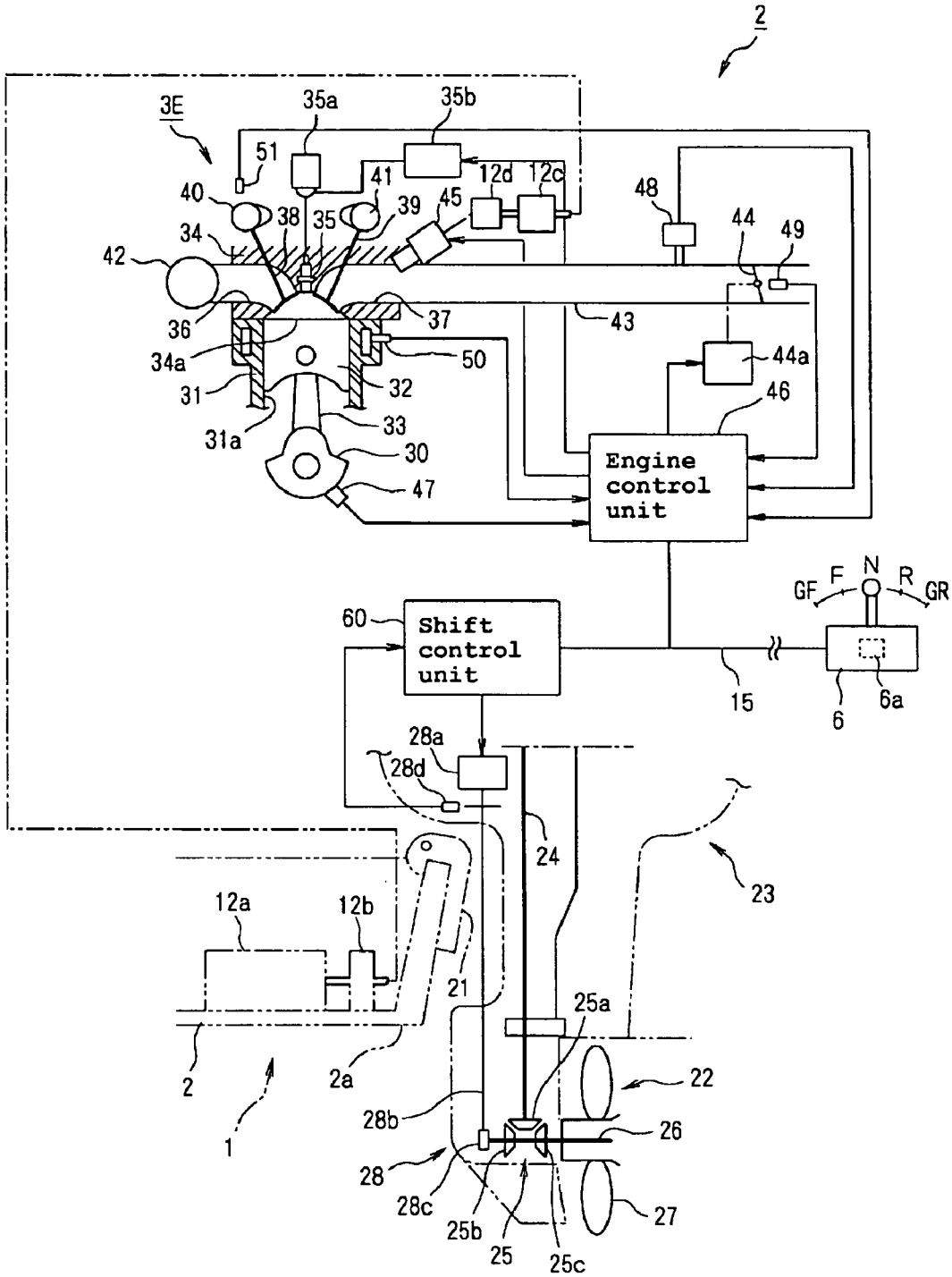
FIG. 2 is a schematic and partial cutaway view of the marine propulsion system of FIG. 1 including an engine.

As shown in FIG. 2, the remote control lever 6 is configured to allow an operator to select a neutral position N, a troll (forward) position F, a reverse troll position R, a troll accelerating range GF or a reverse troll accelerating range GR by changing the position of the lever, although other types of control devices or power request devices can also be used. In this embodiment, the remote control lever 6 can include a rotational position sensor 6*a* comprising a rotary potentiometer, an optical encoder or other devices for detecting the rotational angle of the remote control lever 6.

The outboard motor 3 is supported on a stern 2*a* of the hull 2 for lateral swinging movement via a clamp bracket 21 as shown in FIG. 2. The outboard motor 3 has a lower case 23, within which a propulsion unit 22 and an engine 3E are housed. The propulsion unit 22 has a drive shaft 24 extending vertically, a propeller shaft 26 connected to the lower end of the drive shaft 24 via a bevel gear mechanism 25, and a propeller 27 connected to the rear end of the propeller shaft 26.

The bevel gear mechanism 25 includes a driving bevel gear 25*a* attached to the drive shaft 24, and a forward bevel gear 25*b* and a reverse bevel gear 25*c* rotatably mounted on the propeller shaft 26 and in engagement with the driving bevel gear 25*a*.

The propulsion unit 22 has a forward/reverse switching unit 28. The forward/reverse switching unit 28 has a shift rod 28*b* rotatably driven preferably by an electric motor 28*a* and extending vertically, and a dog clutch 28*c* connected to the shift rod 28*b*. The propulsion unit 22 is switched between a forward or reverse state in which either the forward bevel gear 25*b* or the reverse bevel gear 26*c* is connected to the propulsion shaft 26 and a neutral state in which neither the forward bevel gear 25*b* nor the reverse bevel gear 26*c* is connected to the propulsion shaft 26 by the dog clutch 28*c*.

The engine 3E is a water-cooled, four-cycle, six-cylinder, fuel injection engine as shown in FIG. 2, although other engines operating in accordance with other combustion principles (e.g., diesel, rotary, 2-strke, etc.) having other numbers of cylinders can also be used. The engine 3E is disposed such that its crankshaft 30 extends generally vertically during running. The lower end of the crankshaft 30 is connected to the upper end of the drive shaft 24. The engine 3E has pistons 32 inserted in cylinders 31*a* formed in a cylinder block 31 and connecting rods 33 connecting the pistons 32 and the crankshaft 30.

A cylinder head 34 is fastened to the rear side of the cylinder block 31. Spark plugs 35 are provided in combustion chambers 34*a* defined by the cylinders 31*a* and the cylinder head 34. Exhaust valves 38 and intake valves 39 are disposed in exhaust ports 36 and intake ports 37, respectively, in communication with the combustion chambers 34*a*. The valves 38 and 39 are opened and closed by camshafts 40 and 41, respectively, disposed in parallel to the crankshaft 30. Reference numeral 35*a* denotes an ignition coil and as 35*b* is an igniter.

An exhaust manifold 42 is connected to the exhaust ports 36, so that exhaust gas is exhausted through the exhaust manifold 42 and the lower case 23 and discharged from a rear end of the propulsion unit 22.

An intake pipe 43 is connected to each of the intake ports 37. An electronically controlled throttle valve 44 can be disposed in each intake pipe 43. Fuel injectors 45 are inserted in the cylinder head 34 at positions where the intake ports 37 are formed. The fuel injectors 45 have injection ports oriented to the openings of the intake ports 37.

Fuel is supplied from a fuel supply system 12 disposed at the stern 2*a* of the hull 2 to the fuel injectors 45. The fuel supply system 12 has a fuel tank 12*a* disposed at the stern 2*a* of the hull 2, a fuel pump 12*b* for feeding fuel in the fuel tank 12*a* to a vapor separator tank 12*c* disposed on the engine side, and a high-pressure pump 12*d* for feeding fuel in the tank 12*c* to the fuel injectors 45.

The engine 3E can have an engine control unit 46 as engine control means constituted of, for example, a microcomputer. Detection values or signals from various sensors, including, for example, but without limitation, an engine speed sensor 47 for detecting the rotational speed of the crankshaft 30, an intake pressure sensor 48, a throttle opening sensor 49, an engine temperature sensor 50, and a cylinder discriminating sensor 51 are transmitted to the engine control unit 46.

A boat speed detection value from a boat speed sensor (not shown), a throttle opening command value, as determined by a position of the remote control lever 6, etc., are input into the engine control unit 46 via a bus 15 which can comprise a local area network which can operate in accordance with any known digital communication network protocols, or other protocols. The engine control unit 46 controls the amount and timing of fuel injected from the fuel injectors 45 and ignition timing of the spark plugs 35 based on an engine speed detected by the engine speed sensor 47 and detection values from other sensors according to an operation control map stored therein in advance to control the engine speed.

The electric motor 28*a* of the forward/reverse switching unit 28 is driven for rotation by a shift control unit 60 which can comprise a microcomputer, a hard-wired device, or other devices. When one of the forward position, reverse position and neutral position is selected by the remote control lever 6, shift position detection data corresponding to the selected position is transmitted to the shift control unit 60 via the bus 15. When the shift position detection data indicate the forward position, the shift control unit 60 rotates the shift rod 28*b* to activate the dog clutch 28*c* so that the forward bevel gear 25*b* is brought into meshing engagement with the driving bevel gear 25*a*. When the shift position detection data indicate the reverse position, the shift control unit 60 rotates the shift rod 28*b* to actuate the dog clutch 28*c* so that the reverse bevel gear 25*c* is brought into meshing engagement with the driving bevel gear 25*a*. When the shift position detection data indicate the neutral position, the shift control unit 60 rotates the shift rod 28*b* to activate the dog clutch 28*c* so that the forward bevel gear 25*b* and the reverse bevel gear 25*c* are both separated from the driving bevel gear 25*a*.

Figure 3:
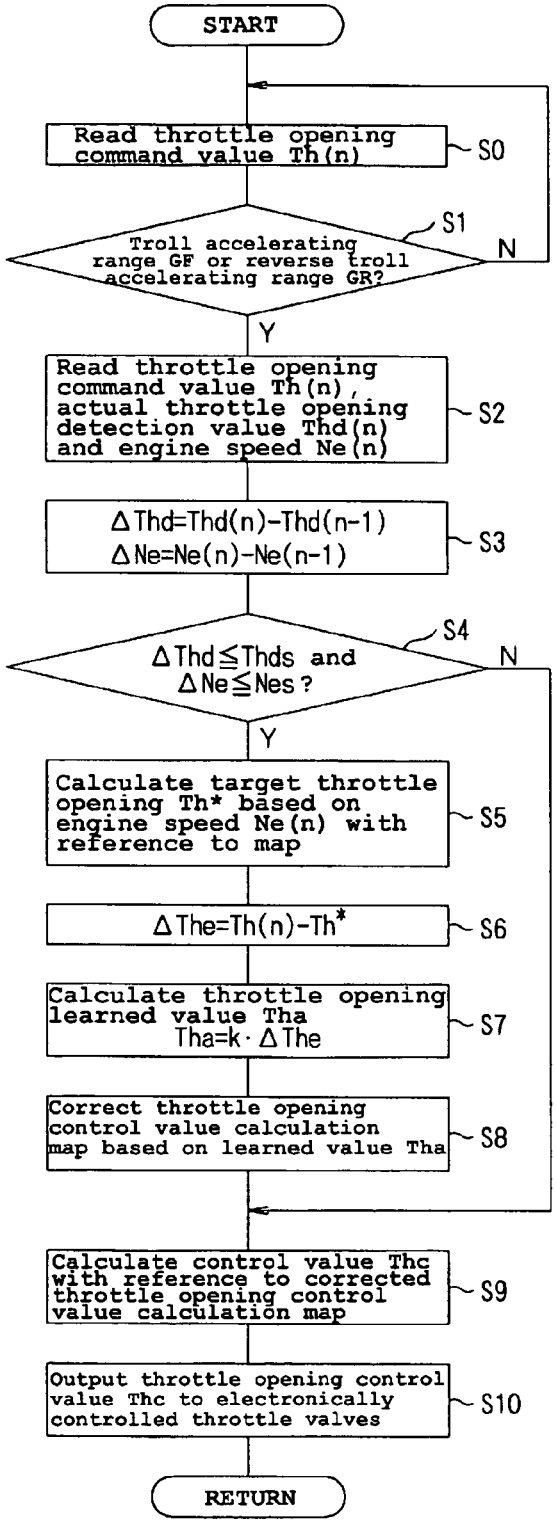
FIG. 3 is a flowchart, showing an example of a procedure of a throttle opening control process which can used with the engine.

When a throttle opening command value is input into the engine control unit 46 from the remote control lever 6 via the bus 15, the engine control unit 46 performs throttle opening control process shown in FIG. 3 based on the throttle opening command value.

FIG. 3 illustrates a throttle control process that can be used with the engine 3E. The process can include reading a throttle request signal. For example, a throttle opening command value Th(n) output from the remote control lever 6 can be read in step S0. Then, in step S1, it can be determined whether the remote control lever 6 is in the troll accelerating range GF or the reverse troll accelerating range GR. A corresponding throttle opening command value other than 0 can then be output. If the remote control lever is in the neutral position N outside the troll accelerating range GF and the reverse troll accelerating range GR, the process returns to the beginning and repeats. Thus, for example, the engine control unit 46 waits until the remote control lever 6 is shifted to the troll accelerating range GF or the reverse troll accelerating range GR before proceeding any further with the process of FIG. 3. When the remote control lever 6 is in the troll accelerating range GF or the reverse troll accelerating range GR, the process goes to step S2.

In the step S2, a throttle opening command value Th(n) output from the remote control lever 6 and an actual throttle opening detection value Thd output from the throttle opening sensor 49 can be read. Additionally, an engine speed Ne(n) detected by the engine speed sensor 47 can be read. Then, in step S3, the change rate ΔThd from the previous actual throttle opening detection value Thd(n−1) and the change rate ΔNe from the previous engine speed Ne(n−1) can be calculated. The process then goes to step S4.

In step S4, it can be determined whether the driving state of the engine 3E is in a steady state. The determination can be made by judging whether the change rate ΔThd of the actual throttle detection value Thd is not greater than a preset value ΔThds. The predetermined rate change ΔThds can be any value, depending on the desired response characteristic of the system. In an exemplary but non-limiting embodiment, the predetermined rate change ΔThds can be one degree (where the position or opening of the throttle valve is measure in degrees of rotation.

Similarly, it can be determined whether the rate of change of the engine speed ΔNe is not greater than a preset value ΔNes. The preset value ΔNes can be any value, depending on the desired response characteristic of the system. In an exemplary but non-limiting embodiment, the preset value ΔNes can be 300 rpm/min, for example. When the change rate ΔThd of the actual throttle detection value Thd is greater than predetermined rate change ΔThds (e.g., 1 deg) or the change rate ΔNe of the engine speed Ne is greater than ΔNes (e.g., 300 rpm/min), the engine is determined to be in a transient state and the process proceeds to the step S9, described below. When the change rate ΔThd of the actual throttle detection value Thd is not greater than ΔThds, one deg and the change rate ΔNe of the engine speed Ne is not greater than ΔNes, the engine is determined to be in the steady state and the process goes to step S5.

Figure 4:
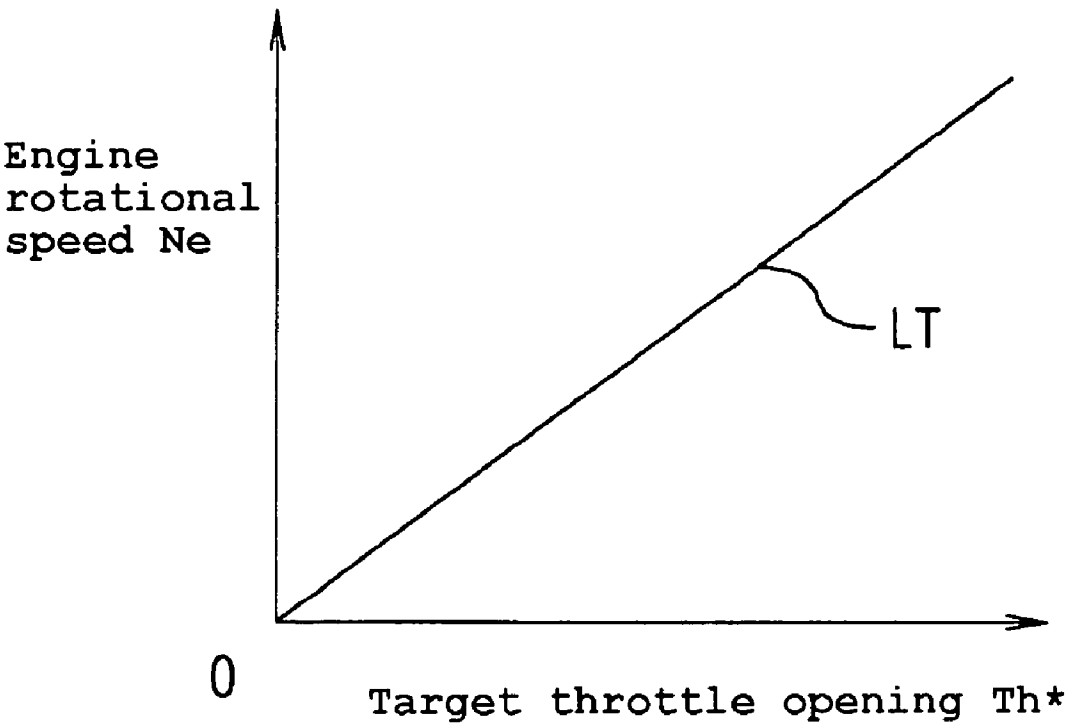
FIG. 4 includes an exemplary characteristic curve, showing a relationship between a target throttle opening and engine speed that can be used with the procedure of FIG. 3.

In the step S5, a target throttle opening Th* is calculated based on the engine speed Ne with reference to a corresponding target throttle opening. For example, a target throttle opening can be stored in the control unit 46 as a data map. FIG. 4 illustrates an exemplary but non-limiting map having a curve LT showing a relation between the engine speed Ne and the target throttle opening Th*. The process then proceeds to step S6.

Figure 5:
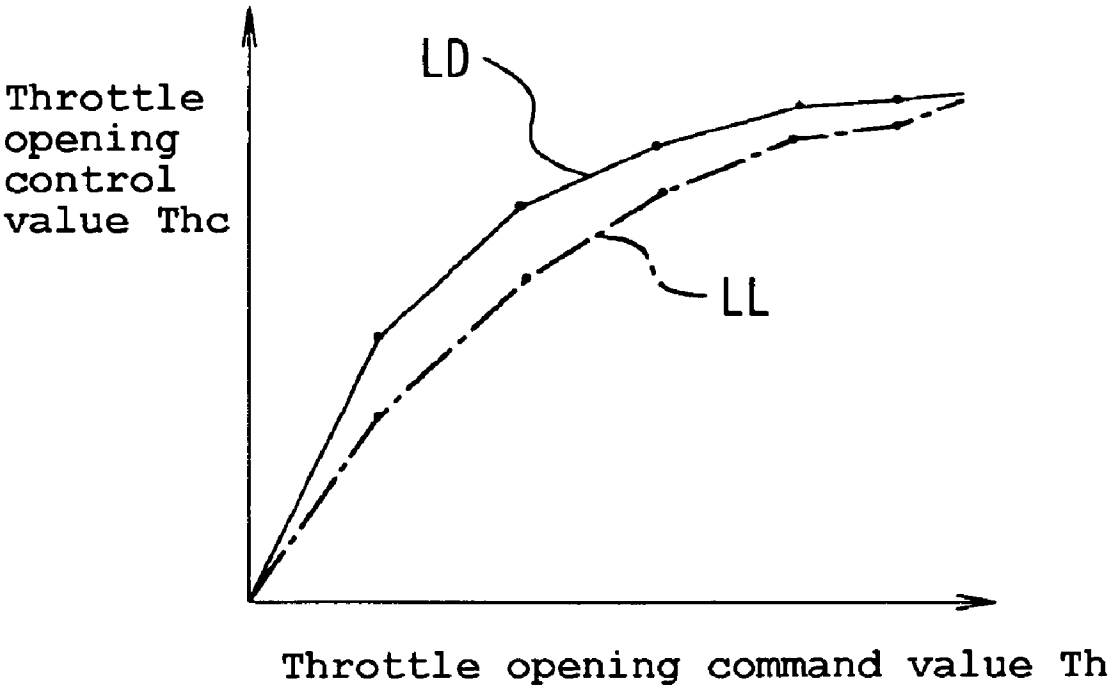
FIG. 5 includes exemplary characteristic curves, showing relationships between a throttle opening control value and a throttle opening command value that can be used with the procedure of FIG. 3.

In the step S6, a throttle opening deviation ΔThe (=Th(n)−Th*) can be obtained by subtracting the target throttle opening Th* from the current throttle opening command value Th(n). Then, in step S7, a throttle opening learned value Tha can be obtained by multiplying the throttle opening deviation ΔThe by a correction coefficient k. Then, in step S8, a default value of a throttle opening control value calculation map (illustrated as curve LD) as shown in FIG. 5 is corrected based on the calculated throttle opening learned value Tha, and the corrected throttle opening control value calculation map (illustrated as curve LL) is stored in a non-volatile memory in an overwriting fashion.

Then, in step S9, a throttle opening control value Thc is calculated based on the current throttle opening command value Th(n) with reference to the throttle opening control value calculation map stored in the non-volatile memory. Then, in step S10, the calculated throttle opening control value Thc is output to the electronically controlled throttle valves 44. Then, the process goes back to step S1.

In operation, the process of FIG. 3 can begin when the small boat 1 is stopped with the engine 3E of the outboard motor 3 stopped. A main switch (not shown) can be turned on to energize the equipment on the small boat 1. Then, a starter switch (not shown) can be held on for a required period of time to start the engine 3E (e.g., to run a starter motor and being the combustion process).

When power is supplied, the engine control unit 46 starts operating, and performs engine control process for controlling the amount and the timing of fuel injected from the fuel injection valves 45 and the ignition timing of the spark plugs 35 and the throttle opening control process shown in FIG. 3 based on the engine speed detected by the engine speed sensor 47 and detection values from other sensors according to an operation control map stored therein in advance.

In this throttle opening control process, since the remote control lever 6 is in the neutral position N, the engine control unit 46 performs the steps S0 and S1 repeatedly, so as to keep the process in a standby state until the remote control lever 6 is shifted to the troll accelerating range GF or the reverse troll accelerating range GR.

Then, when the remote control lever 6 is rotated, for example, to the troll accelerating range GF to start cruising, a throttle opening command value Th(n), other than zero, corresponding to the rotational position of the remote control lever 6 is output from the lever unit 6 and is input into the engine control unit 46 through the bus 15. An actual throttle opening detection value Thd(n) detected by the throttle opening sensor 49 and an engine speed Ne(n) detected by the engine speed sensor 47 are also input into the engine control unit 46.

At this time, since the throttle opening control process shown in FIG. 3 is performed in the engine control unit 46 and a throttle opening command value Th(n) other than zero is input, it is determined that the remote control lever 6 has been rotated to the troll accelerating range GF or the reverse troll accelerating range GR and then the process goes to step S2. Then, a throttle opening command value Th(n), an actual throttle opening detection value Thd(n) and an engine speed Ne(n) are read.

After the small boat 1 starts accelerating forward running, the change rate ΔThd of the actual throttle detection value Thd(n) is greater than the preset value ΔThds and/or the change rate ΔNe of the engine speed Ne(n) is greater than the preset value ΔNes, that is, the engine is in the transient state. Thus, the process goes from step S4 to step S9. Then, a throttle opening control value Thc is calculated, without performing new leaning, based on the current engine speed Ne(n) with reference to the throttle opening control value calculation map stored in the non-volatile memory shown in FIG. 5. When the calculated throttle opening control value Thc is output to the electronically controlled throttle valves 44, the opening of the electronically controlled throttle valves 44 is controlled to increase the engine speed Ne.

After that, when the remote control lever 6 is shifted to a desired position in the troll accelerating range GF, the throttle opening command value Th(n) output from the remote control lever 6 becomes more stable. Then, the throttle opening control value Thc calculated in the throttle opening control process shown in FIG. 3 becomes substantially constant and the actual throttle detection value Thd(n) detected by the throttle opening sensor 49 becomes generally constant.

Thus, the engine speed Ne(n) of the engine 3E becomes generally constant and the engine is determined to be in a steady state in step S4. Then, in step S5, a target throttle opening Th* is calculated based on the current engine speed Ne(n) with reference to the target throttle opening calculation map shown in FIG. 4. Then, in step 6, the target throttle opening Th* is subtracted from the current throttle opening command valve Th(n) to obtain a throttle opening deviation ΔThe, and in step 7 a throttle opening learned value Tha is obtained by multiplying the throttle opening deviation ΔThe by a correction coefficient k in step S7. Then, in step S8, the throttle opening control value calculation map is corrected based on the calculated throttle opening learned value Tha, and the corrected throttle opening control value calculation map is stored in a non-volatile memory.

Thus, the throttle opening control calculation map is corrected from a characteristic curve LD showing default values as shown by a solid line in FIG. 5 to the characteristic curve LL showing learned values as shown by a dot-dash line.

Then, a throttle opening control value Thc is calculated based on the current throttle opening command value Th(n) with reference to the corrected throttle opening control value calculation map in step S9, and the calculated throttle opening control value Thc is output to the electronically controlled throttle valves 44 in step S10.

Figure 6:
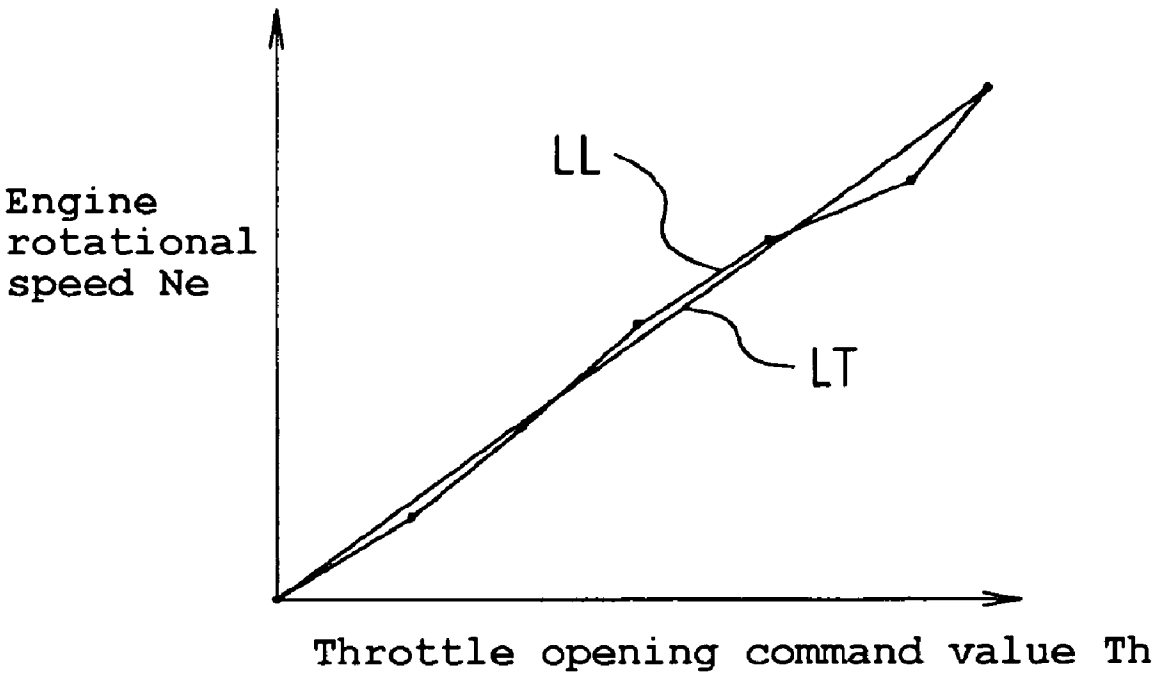
FIG. 6 includes exemplary characteristic curves, showing relationships between the throttle opening command value and the engine speed that can be used with the procedure of FIG. 3.

Thus, the relation between the throttle opening command value Th(n) and the engine speed Ne (n) exhibits a curve, like the polygonal line characteristic curve LL in FIG. 6, which generally coincides with the characteristic curve LT showing the target throttle opening Th* as shown by dot-dash line in FIG. 6, and learning control is performed so that the displacement of the remote control lever 6 and the engine speed generally can coincide with target values regardless of the resistance property of the hull.

Figure 7:
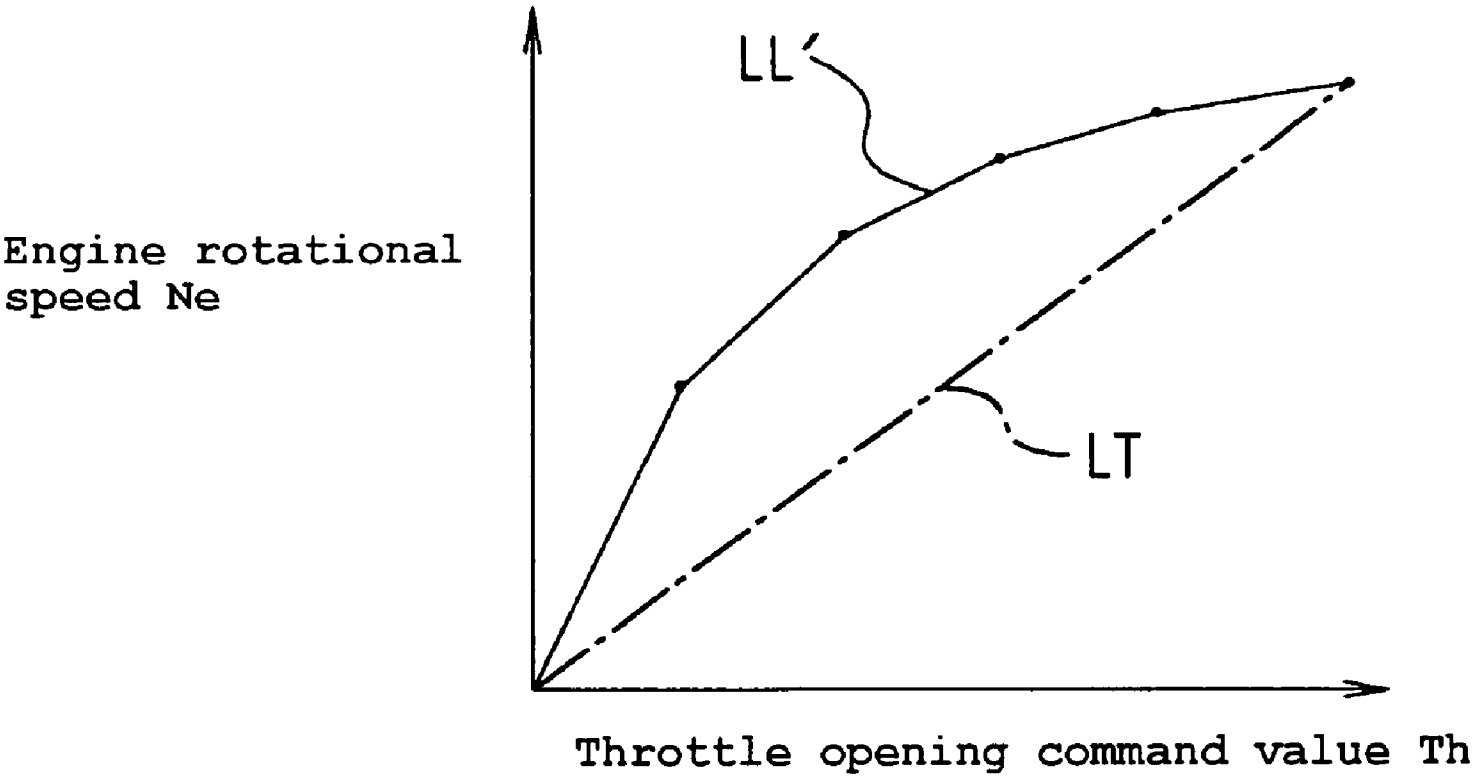
FIG. 7 includes further exemplary characteristic curves, showing relationships between the throttle opening command value and the engine speed in the case where learning control is not performed and that can be used with the procedure of FIG. 3.

In the case where learning control is not performed, when the throttle opening command value Th is plotted on the horizontal axis and the engine speed Ne on the vertical axis, the relation between them exhibits a polygonal line curve like a characteristic curve LL' shown in FIG. 7 in contrast to a characteristic curve LT showing the target throttle opening Th* when the hull resistance is large. That is, the gradient of the characteristic curve LL' is relatively large in the range in which the throttle opening command value Th is small and gradually decreases as the throttle opening command value Th increases. Thus, speed control is difficult in the range in which the engine speed Ne is low. This tendency is strong in four-stroke engines in particular. Thus, when the user wants to troll at a low speed to do, for example, fishing, the user has to control the engine speed Ne constantly while doing fishing since the engine speed Ne is difficult to control. This can be annoying or inconvenient for the user.

In the process of FIG. 3, however, the characteristic of the engine speed Ne to the throttle opening command value Th can be as shown by the characteristic curve LL which generally coincides with the characteristic curve LT showing the target throttle opening Th* as shown in FIG. 5. Thus, the amount of change in the engine speed Ne to the throttle opening command value Th can be generally constant over the entire range of the engine speed Ne, and the engine speed Ne can be more easily adjusted over its entire range.

Figure 8:
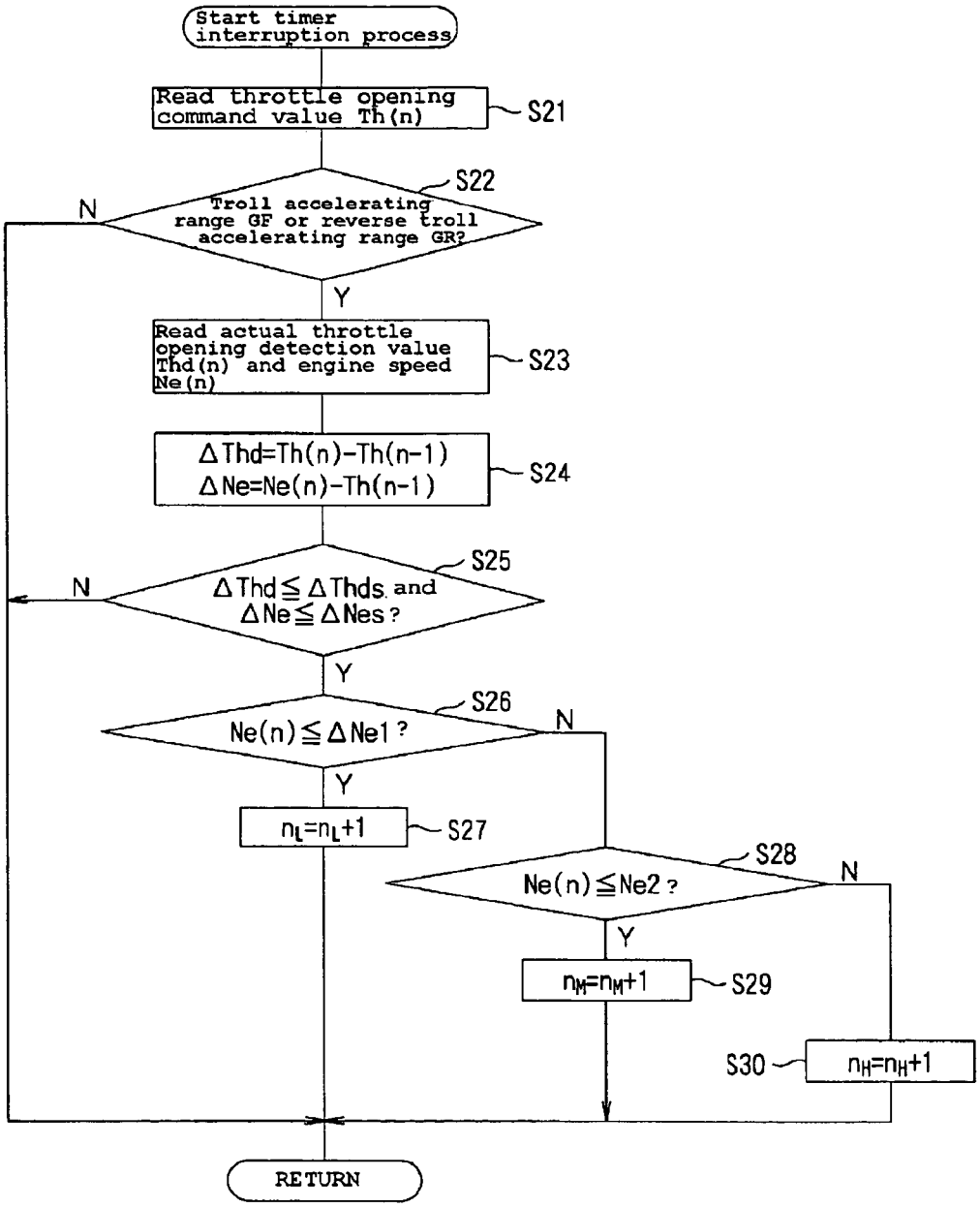
FIG. 8 is a flowchart showing an example of a procedure of an engine speed range measuring process which is performed in an engine control unit in at least one of the embodiments disclosed herein.

FIG. 8 illustrates a modification of the process of FIG. 3. In the FIG. 8 process, the user's manner of cruising is learned so that cruising characteristics suitable for the user's manner of cruising can be obtained.

Figure 9:
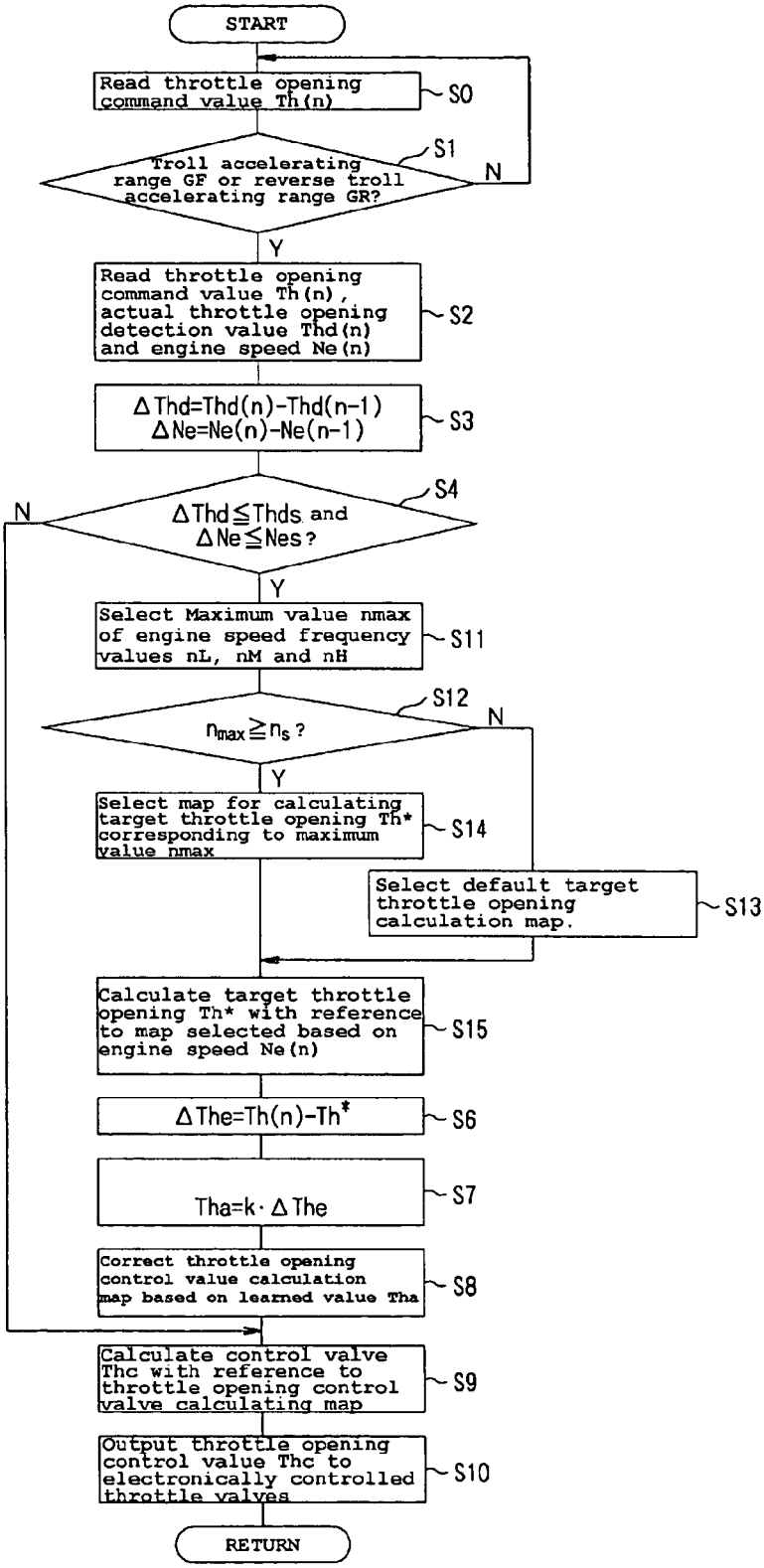
FIG. 9 a flowchart, showing an example of a throttle opening control process performed in an engine control unit in at least one of the embodiments disclosed herein.

In the FIG. 8 process, the engine control unit 46 can perform a process that is similar to the process of FIG. 3, except that the FIG. 8 process can include an engine speed range measuring process for measuring the frequency of use of engine speed ranges. Optionally, the throttle opening control process can be changed as shown in FIG. 9.

The engine speed range measuring process of FIG. 8 can be performed as timer interruption process in a main program. As shown in FIG. 8, a throttle opening command value Th(n) input from the throttle lever 6 is read in step S21. In step S22, it is determined whether the throttle opening command value Th(n) is other than zero, that is, whether the remote control lever 6 is in the troll accelerating range GF or the reverse troll accelerating range GR. If the throttle opening command value Th(n) is zero, that is, the neutral position N is selected, the engine speed range measuring process is terminated and the process is returned to the main program. If the throttle opening command value Th(n) is other than zero, it is determined that the troll accelerating range GF or the reverse troll accelerating range GR is selected, and the process proceeds to step S23.

In step S23, an actual throttle opening detection value Thd(n) detected by the throttle opening sensor 49 and an engine speed Ne(n) detected by the engine speed sensor 47 are read. In step S24, the change rate ΔThd of the of the actual throttle detection value (=Thd(n)−Thd(n−1)) and the change rate ΔNe of the engine speed (=Ne(n)−Ne(n−1)) can be calculated. Then, the process proceeds to step S25.

In step S25, it can be determined whether the engine 3E is in the steady state in which the change rate ΔThd of the actual throttle detection value is not greater than a preset value ΔThds and/or in which the change rate ΔNe of the engine speed is not greater than a preset value ΔNes. If ΔThd>ΔThds or ΔNe>ΔNes, the engine 3E is determined to be in a transient state. Then, the timer interruption process is terminated and the process is returned to the main program. If ΔThd ΔThds and ΔNe ΔNes, the engine 3E is determined to be in the steady state and the process goes to step S26.

In step S26, it can be determined whether the current engine speed Ne(n) is not greater than the maximum engine speed Ne1 in the low-speed range, that is, in the low-speed cruising range for low-speed trolling suitable for fishing or the like. If Ne(n) Ne1, the current engine speed Ne(n) is determined to be in the low-speed cruising range, and the process goes to step S27.

In the step S27, a low-engine speed frequency value $n_L$ indicating the frequency for selecting the low-speed cruising range and stored in a non-volatile memory is read, and a value obtained by incrementing it by 1 is stored in a specified memory area in the non-volatile memory in an overwriting fashion as a new low-engine speed frequency value $n_L$. Then, the timer interruption process is terminated and the process is returned to the main program. If Ne(n)> Ne1, the process goes to step S28.

In step S28, it is determined whether the current engine speed Ne(n) is not greater than the maximum engine speed Ne2 in the medium-speed range, that is, in the medium-speed cruising range suitable for towing sports such as wakeboarding and water-skiing. If Ne(n) Ne2, the current engine speed Ne(n) is determined to be in the medium-speed cruising range, and the process goes to step S29.

In step S29, a medium-engine speed frequency value $n_M$ indicating the frequency for selecting the medium-speed cruising range and stored in the non-volatile memory is read, and a value obtained by incrementing it by 1 is stored in a specified memory area in the non-volatile memory in an overwriting fashion as a new medium-engine speed frequency value $n_M$. Then, the timer interruption process is terminated and the process is returned to the main program. If Ne(n)>Ne2, the current engine speed Ne is determined to be in the high-speed cruising range and the process goes to step S30.

In step S30, an high-engine speed frequency value $n_H$ indicating the frequency for selecting the high-speed cruising range and stored in the non-volatile memory is read, and a value obtained by incrementing it by 1 is stored in a specified memory area in the non-volatile memory in an overwriting fashion as a new high-engine speed frequency value $n_H$. Then, the timer interruption process is terminated and the process is returned to the main program.

In the process of FIG. 8, the throttle opening control process can be the same as the throttle opening control process of the first embodiment shown in FIG. 3, except that step S5 is omitted and a selection process for selecting a target throttle opening calculation map in steps S11 to S15 is interposed between steps S4 and S5, as shown in FIG. 9. Thus, the steps corresponding to the steps in FIG. 3 are designated by the same numerals and their detailed description is not repeated.

In the selection process, if ΔThd ΔThds and ΔNe ΔNes in step S4, the engine speed frequency values $n_L$, $n_M$ and $n_H$ are read from the non-volatile memory and the maximum value $n_{max}$(=max ($n_L$, $n_M$, $n_H$)) of the engine speed frequency values $n_L$, $n_M$ and $n_H$ are calculated in step S11. Then, in step S12, it is determined whether the calculated maximum value $n_{max}$ is not smaller than a preset value $n_s$ indicating whether a predetermined learned value can be treated as effective. If $n_{max}<n_s$, the process goes to step S13, and a default target throttle opening calculation map shown in FIG. 4 in the first embodiment is selected. Then, the process goes to step S15. If $n_{max}$ $n_s$, the process goes to step S14.

Figure 10:
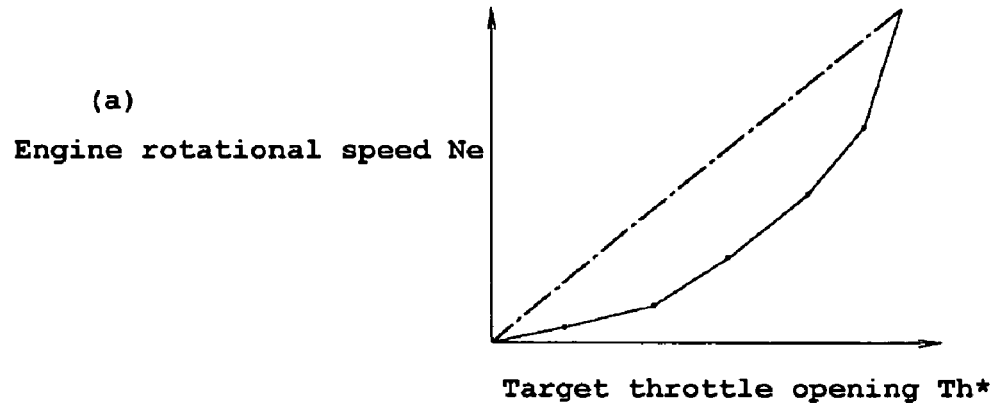
FIGS. 10(*a*), (*b*), and (*c*) illustrate exemplary characteristic curves showing relationships between target throttle opening and engine speeds than can be used with the procedure of FIG. 9.
Figure 10:
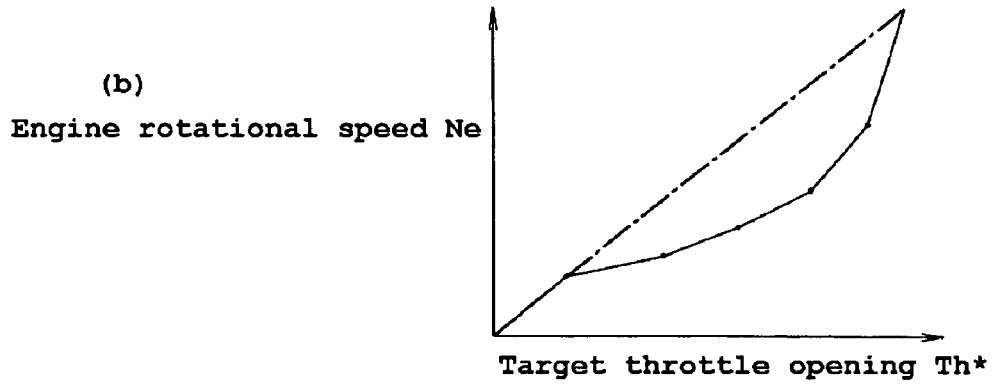
Figure 10:
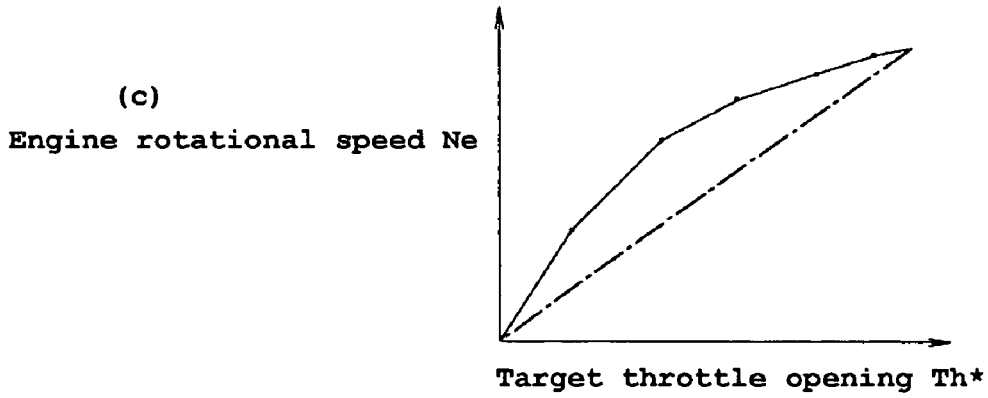

In step S14, a target throttle opening calculation map corresponding to the maximum engine speed frequency value frequency value $n_i$(i=L, M, or H) is selected. Then, the process goes to step S15. In the process for selecting a target throttle opening calculation map, when the engine speed frequency value $n_L$ is the maximum, a target throttle opening calculation map for low-speed cruising as shown in FIG. 10(*a*) is selected. The target throttle opening calculation map of FIG. 10(*a*) is an exemplary map that can be used with the process of FIGS. 8 and 9. Other maps can also be used. Such maps can differ depending on the inherent response characteristics of the engine. For example, different engines have different throttle response characteristics. Further, engines that have identical hardware can also have different throttle response characteristics, due to for example those differences caused by dimensional and performance variations within acceptable manufacturing tolerances. Thus, the map illustrated in FIG. 10(*a*), as well as the maps of FIG. 10(*b*) and (*c*), can be different for different engines. However, one of ordinary skill in the art can understand how to provide different maps for providing relatively more precise control in selected engine speed ranges. Additionally, one of ordinary skill in the art can create maps for fewer engine speed ranges or more engine speed ranges, and provide for the selection for such fewer or additional maps with modifications to the processes of FIGS. 8 and 9.

With the exemplary target throttle opening calculation map for low-speed cruising (FIG. 10(*a*)), the target throttle opening Th* is on the horizontal axis and the engine speed Ne is on the vertical axis. In the range in which the target throttle opening Th* is low, the rate of increase in the engine speed Ne is smaller than that in the target throttle opening Th*. That is, the gradient of the characteristic curve is small in the low-speed range so that the engine speed can be controlled precisely, and relatively large in the medium- and high-speed ranges.

When the engine speed frequency value $n_M$ is the maximum, a target throttle opening calculation map for medium-speed cruising as shown in FIG. 10(*b*) is selected. In the target throttle opening calculation map for medium-speed cruising, the target throttle opening Th* is on the horizontal axis and the engine speed Ne is on the vertical axis as in the case with the target throttle opening calculation map for low-speed cruising. In the range in which the target throttle opening Th* is low, the characteristic curve has a constant gradient as in the case with the default target throttle opening calculation map. In the medium-speed range, the rate of increase in the engine speed Ne is smaller than that in the target throttle opening Th*. In other words, the gradient of the characteristic curve is small in the medium-speed range so that the engine speed can be controlled precisely. In the high-speed range, the gradient of the characteristic curve is relatively large.

When the engine speed frequency value n(H) is maximum, a target throttle opening calculation map for high-speed cruising as shown in FIG. 10(*c*) is selected. In the target throttle opening calculation map, the target throttle opening Th* is on the horizontal axis and the engine speed Ne is on the vertical axis as in the case with the target throttle opening calculation map for low-speed cruising. The rate of increase in the engine speed Ne is greater than that in the target throttle opening Th* in the low- and medium speed ranges in which the target throttle opening Th* is low. In the high-speed range, the rate of increase in the engine speed Ne is smaller than that in the target throttle opening Th*. That is, the gradient of the characteristic curve is small in the high-speed range so that the engine speed can be controlled more precisely.

In step S15, a target throttle opening Th* is calculated with reference to one of the target throttle opening calculation map for low-speed cruising, the target throttle opening calculation map for medium-speed cruising and the target throttle opening calculation map for high-speed cruising selected based on the current engine speed Ne(n), and the process goes to step S6.

In operation (using the processes of FIGS. 8 and 9), when a hull 2 and the outboard motor 3, or only the outboard motor 3 is newly purchased, the engine speed frequency values $n_L$, $n_M$, and $n_H$ stored in a non-volatile memory of the engine control unit 46 and preferably are set to zero.

The main switch can be switched on to energize the equipment on the boat with the remote control lever 6 positioned in the neutral position N after the outboard motor 3 has been attached to the hull 2, the engine control unit 46 starts performing the steps shown in FIGS. 8 and 9. However, since the remote control lever 6 is in the neutral position N and the throttle opening command value Th(n) is zero, steps 21 and 22 are repeated in the engine speed range measuring process shown in FIG. 8 and the engine speed frequency values $n_L$, $n_M$, and $n_H$ are kept at the initial value 0. Also, steps S1 and S2 are repeated in the throttle opening control process shown in FIG. 9.

When a starter switch (not shown) is held on for a required period of time to start the engine 3E with the remote control lever 6 in the neutral position N, and the operator shifts the remote control lever 6 from the neutral position N to the troll accelerating range GF, for example, to start cruising, a throttle opening command value Th(n) corresponding to the rotational position of the remote control lever 6 in the troll accelerating range GF is output and transmitted to the engine control unit 46 through the bus 15. Additionally, a forward shift command value is transmitted to the shift control unit 60 through the bus 15.

Then, the shift control unit 60 rotates the shift rod 28*b* to activate the dog clutch 28*c* so that the forward bevel gear 25*b* is brought into engagement with the driving bevel gear 25*a*, and the rotation of the drive shaft 24 to which the output torque of the engine 3E is transmitted is therefore transmitted to the propeller 27 via the propeller shaft 26 and the hull 1 is moved forward.

In the engine control unit 46, the remote control lever 6 is in the troll accelerating range GF and the throttle opening command value Th(n) is increased from zero. Thus, in the engine speed range measuring process shown in FIG. 8, the process goes from step S22 to step S23, and the actual throttle opening detection value Thd(n) detected by the throttle opening sensor 49 and the engine speed Ne(n) detected by the engine speed sensor 47 are read. Then, in step S24, the change rate ΔThd of the actual throttle opening detection value and the change rate ΔNe of the engine speed are calculated.

However, after the remote control lever 6 is operated, since the change rate ΔNe of the engine speed Ne and the change rate ΔThd of the actual throttle detection value Thd are large, the engine 3E is determined to be in a transient state. Thus, the timer interruption process is terminated and the engine speed frequency values $n_L$, $n_M$, and $n_H$ are kept at zero.

When the throttle opening control process shown in FIG. 9 is performed in this state, the engine 3E is determined to be in a transient state and the process goes from step S4 to step S9. Then, a throttle opening control value Thc is calculated based on the current throttle opening command value Th with reference to a default characteristic curve LD of the throttle opening control value calculation map shown in FIG. 5. The calculated throttle opening control value Thc is output to the electronic throttle valves 44. The electronic throttle valves 44 are therefore controlled with default characteristics.

Thus, when the resistance of the hull is large, the rate of increase in the engine speed Ne is greater than the change rate in the throttle opening command value Th in the range in which the throttle opening command Th is small as shown in FIG. 7. Thus, the engine speed Ne is controlled in the range in which the throttle opening command Th is small, and thus, the engine speed Ne can change relatively rapidly in response to small movements of the lever 6.

After that, when the remote control lever 6 is stopped at a desired position in the troll accelerating range GF, the change rate ΔThd of the actual throttle opening detection value Thd(n) detected by the throttle opening sensor 49 and the change rate ΔNe of the engine speed Ne detected by the engine speed sensor 47 becomes smaller than the preset values ΔThds and ΔNes, respectively. Thus, the engine 3E is brought into a steady state.

When the engine 3E is brought into a steady state, the process goes from step S25 to step S26 in the engine speed range measuring process shown in FIG. 8. Then, when the current engine speed Ne(n) is in the low-speed range, the process goes from step S26 to step S27 and the low-engine speed frequency value $n_L$ stored in the non-volatile memory is incremented by 1.

In the throttle opening control process shown in FIG. 9, the process goes from step S4 to step S11 since the engine 3E is in a steady state. Then, the maximum value $n_{max}$ of the engine speed frequency values $n_L$ to $n_H$ is selected and it is determined whether the maximum value $n_{max}$ is not smaller than the preset value $n_S$. Since the boat has just started cruising, the maximum value $n_{max}$ is greater than the preset value $n_S$. Thus, the process goes to step S13. In step S13, the default target throttle opening calculation map shown in FIG. 4 is selected.

Then, in step S15, a target throttle opening Th* is calculated based on the current engine speed Ne(n) with reference to the default target throttle opening calculation map. Thus, as in the case with the first embodiment, a throttle opening deviation ΔThe, a throttle opening learned value Tha are calculated, and the calculated throttle opening learned value Tha is added to the default value TD to correct the throttle opening control value calculation map.

As a result, the throttle opening control value calculation map can be corrected from a default characteristic curve LD to a learned characteristic curve LL with a gentle gradient as shown in FIG. 5. Then, a throttle opening control value Thc is calculated with reference to the throttle opening control value calculation map corrected based on the current throttle opening command value Th(n), and the calculated throttle opening control value Thc is output to the electronically controlled throttle valves 44. The relation between the throttle opening command value Th and the engine speed Ne thereby exhibits a learned characteristic curve LL which generally coincides with the default target value curve as shown in FIG. 6. Thus, the cruising characteristics can be in the optimum state regardless of the hull resistance.

When the engine speed range measuring process is continued, engine speed frequency values $n_L$ to $n_H$ are calculated in accordance with the user's manner of cruising. For example, if the user uses a tolling speed often, such as the speeds used for fishing, the engine speed frequency value $n_L$ for low-speed cruising becomes greater than the other frequency values $n_M$ and $n_H$ since the user does low-speed trolling at fishing spots although he may cruise to the fishing spots at a high speed.

Figure 11:
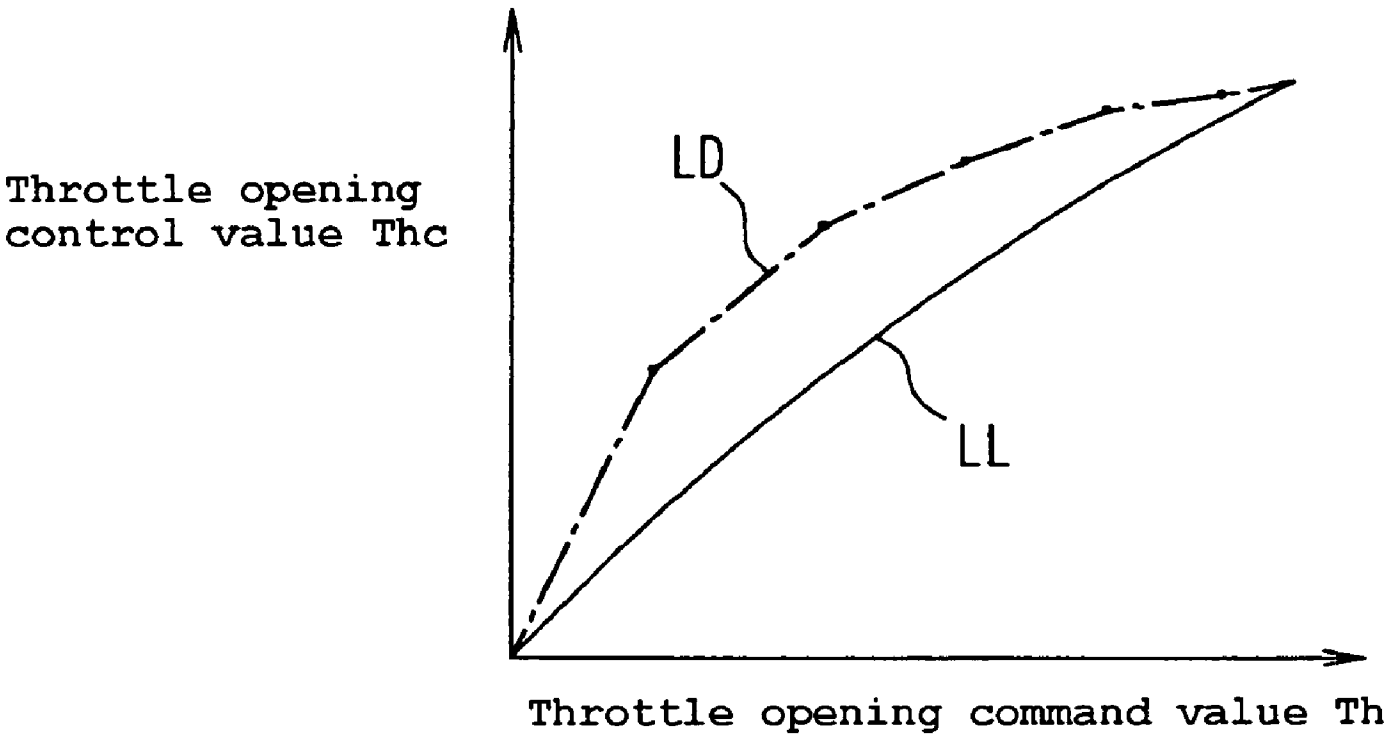
FIG. 11 includes an exemplary characteristic curve, showing a relationship between throttle opening control values and a throttle opening command values that can be used with the procedure of FIG. 9, for example, in an operating mode where the user performs low-speed cruising.

Thus, the engine speed frequency value $n_L$ for low-speed cruising is selected as the maximum value $n_{max}$. Then, when the maximum value $n_{max}$ becomes the preset value $n_s$ or greater, the process goes from step S12 to step S14 in the throttle opening control process shown in FIG. 9 and a target throttle opening calculation map for low-speed cruising corresponding to the engine speed frequency value $n_L$ for low-speed cruising as shown in FIG. 10(*a*) is selected. Then, in step S15, a target throttle opening Th* is calculated with reference to target throttle opening calculation map for low-speed cruising selected based on the current engine speed Ne(n). The calculated target throttle opening Th* is greater than a target throttle opening Th* calculated using the default target throttle opening calculation map shown in FIG. 4. Thus, the throttle opening control value calculation map is corrected to a learned characteristic curve LL close to a straight line as shown in FIG. 11 in step S8.

Figure 12:
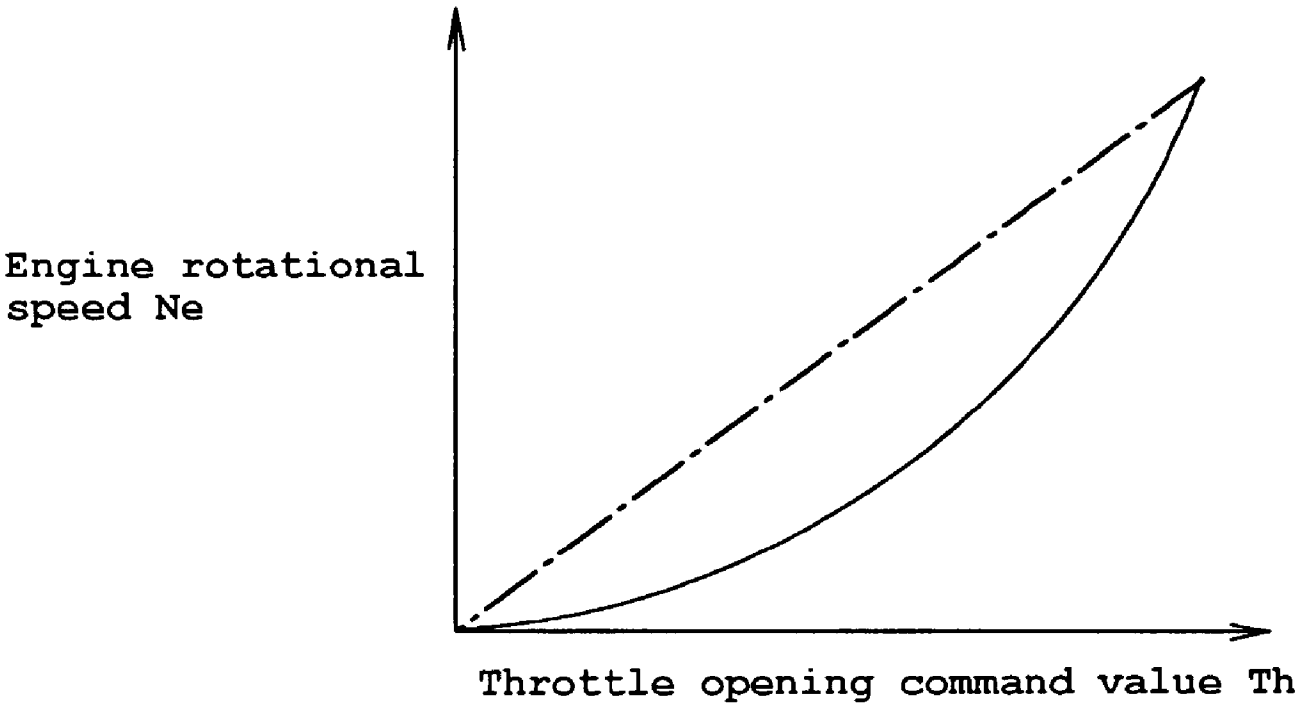
FIG. 12 includes an exemplary characteristic curve, showing a relationship between throttle opening command values and engine speeds that can be used in the procedure of FIG. 9, for example, in an operating mode where the user performs low-speed cruising.

Thus, when a throttle opening control value Thc is calculated with reference to the throttle opening control value calculation map corrected based on the current throttle opening command value Th(n) and the calculated throttle opening control value Thc is output to the electronically controlled throttle values 44 to control the engine speed, the relation between the throttle opening command value Th output from the remote control lever 6 and the engine speed Ne becomes as shown in FIG. 12. That is, the gradient of the characteristic curve is small in the range in which the throttle opening command value Th is small so that the rate of increase in the engine speed Ne relative to the rate of increase in the throttle opening command value Th can be small, and the gradient increases as the throttle opening command value Th increases so that the rate of increase in the engine speed Ne relative to the rate of increase in the throttle opening command value Th increases. As a result, the amount of change in the engine speed Ne in response to the displacement of the remote control lever 6 becomes small in the range in which the engine speed Ne is low, and the engine speed Ne can be controlled more precisely in the low-engine speed range often used for fishing.

Figure 13:
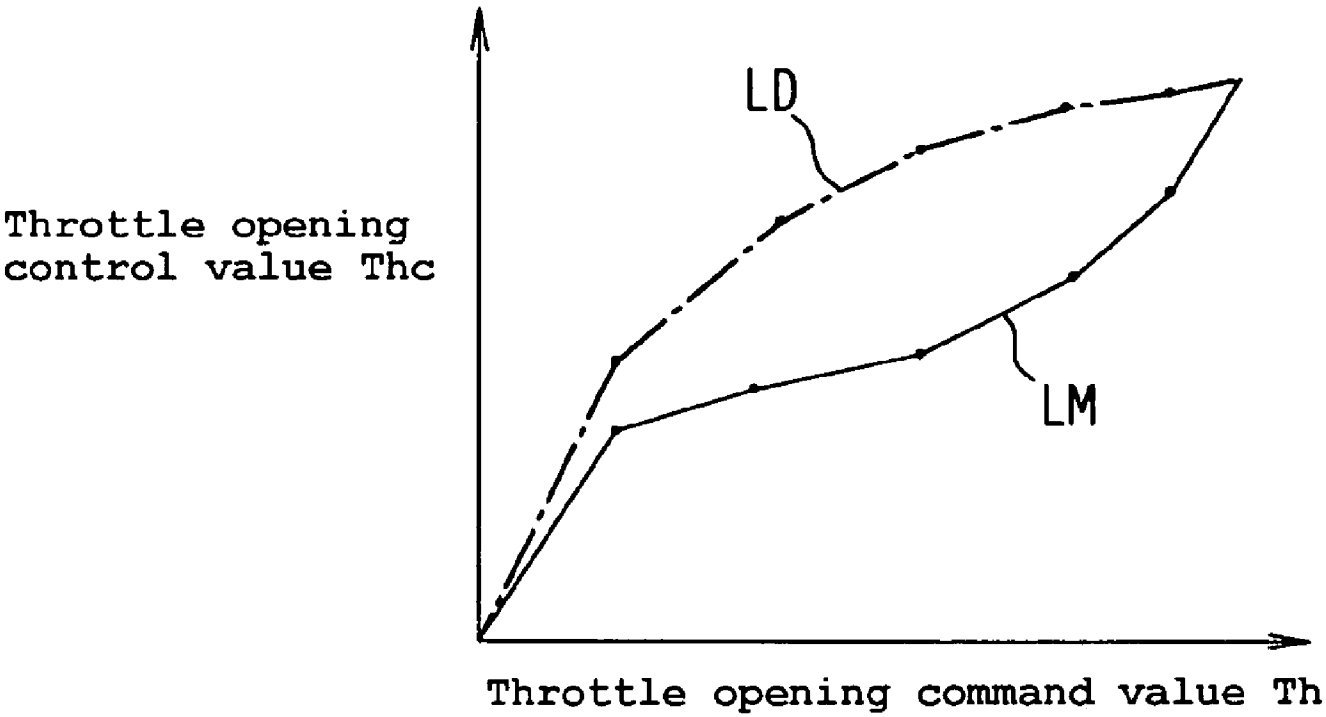
FIG. 13 includes an exemplary characteristic curve, showing a relationship between throttle opening control values and a throttle opening command values that can be used with the procedure of FIG. 9, for example, in an operating mode where the user performs medium-speed cruising.
Figure 14:
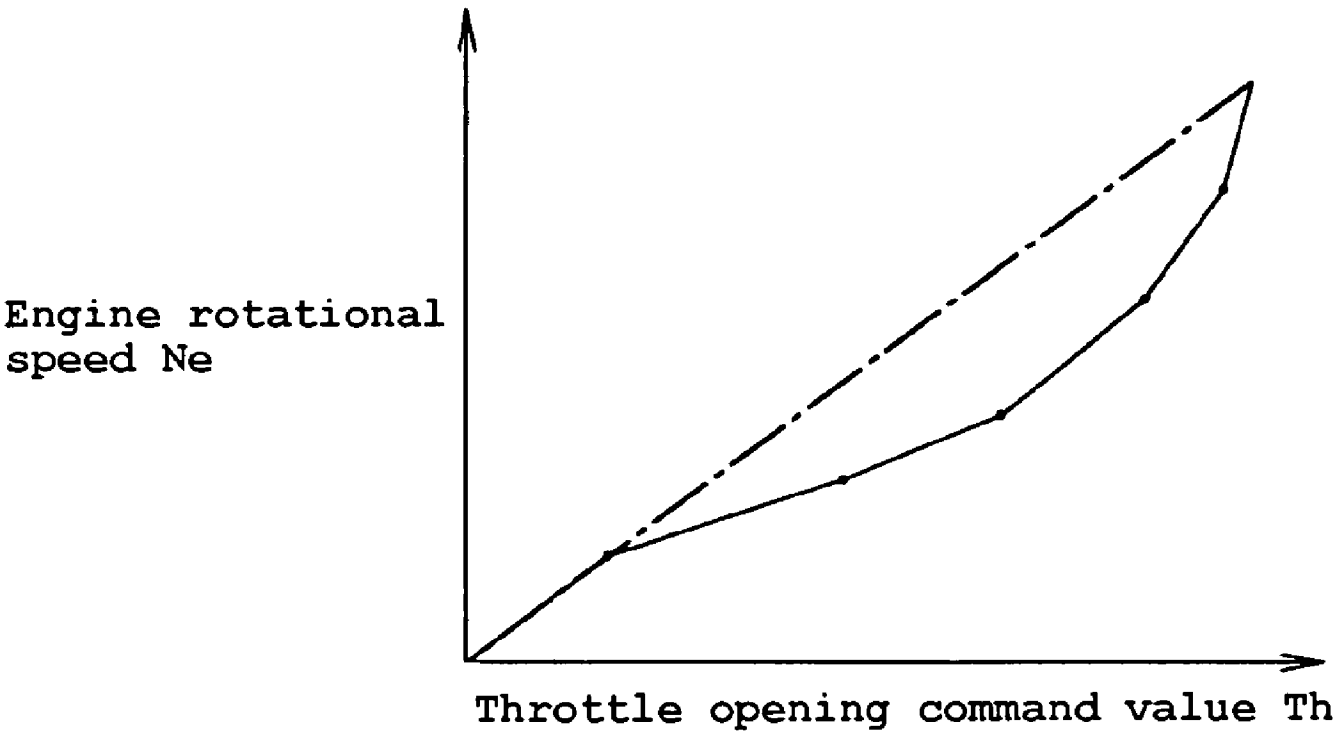
FIG. 14 includes an exemplary characteristic curve, showing a relationship between throttle opening command values and engine speeds that can be used in the procedure of FIG. 9, for example, in an operating mode where the user performs medium-speed cruising.

When the user more often performs medium-speed cruising for towing sports such as wakeboarding and water-skiing, the engine speed frequency value $n_M$ for middle-speed cruising becomes the maximum value $n_{max}$. Thus, in the engine speed range measuring process shown in FIG. 8, the target throttle opening calculation map for medium-speed cruising as shown in FIG. 10(*b*) is selected in step S14 in the throttle opening control process shown in FIG. 9 and a target throttle opening Th* is calculated using the map of FIG. 10(*b*). Then, the throttle opening control value calculation map is corrected to a medium-speed characteristic curve LM as shown in FIG. 13 in which the rate of increase in the throttle opening control value Thc is smaller than the rate of increase in the throttle opening command value Th in the range in which the throttle opening command value Th is medium, and greater in the high-speed range in step S8. Thus, the relation between the throttle opening command value Th output from the remote control lever 6 and the engine speed Ne becomes as shown in FIG. 14. That is, the characteristic curve exhibits a straight line coincident with the default target throttle opening Th* in the low-speed cruising range. The rate of increase in the engine speed Ne is smaller than the rate of increase in the throttle opening command value Th in the medium-speed cruising range, and greater in the high-speed cruising range. Thus, the engine speed Ne can be controlled more precisely in the medium-speed cruising range suitable for towing sports.

When the user more often performs high-speed cruising on oceans, the engine speed frequency value $n_H$ for high-speed cruising calculated in the engine speed range measuring process shown in FIG. 8 becomes the maximum value $n_{max}$. Thus, a target throttle opening calculation map for high-speed cruising as shown in FIG. 10(*c*) is selected in step S14 in the throttle opening control process in FIG. 9 and the relation between the throttle opening command value Th output from the remote control lever 6 and the engine speed Ne becomes generally coincident with the target throttle opening calculation map for high-speed cruising. That is, the rate of increase in the engine speed is greater than the rate of increase in the throttle opening command value Th in the low- and medium-speed ranges, and smaller in the high-speed range. Thus, the engine speed Ne can be controlled precisely in the high-speed cruising range.

Although the cruising range is divided into three ranges: the low-speed cruising range, the medium-speed cruising range and the high-speed cruising range, in the second embodiment, the present invention is not limited thereto. The cruising range may be divided into two ranges; a low-speed cruising range and a high-speed cruising range. The cruising range may be divided into four or more ranges to set the cruising characteristics more finely.

Although the cruising characteristics are changed by selecting a target throttle opening calculation map in the second embodiment, the present invention is not limited thereto. The correction coefficient k may be changed depending on the cruising ranges.

Also, although the user's manner of cruising is automatically determined through the engine speed range measuring process shown in FIG. 9 in the second embodiment, the present invention is not limited thereto. A cruising characteristic selection switch with which the user can arbitrarily set a cruising characteristic may be provided so that a target throttle opening calculation map can be selected or the correction coefficient k can be changed depending on the cruising range selected by the cruising characteristic selection switch.

Figure 15:
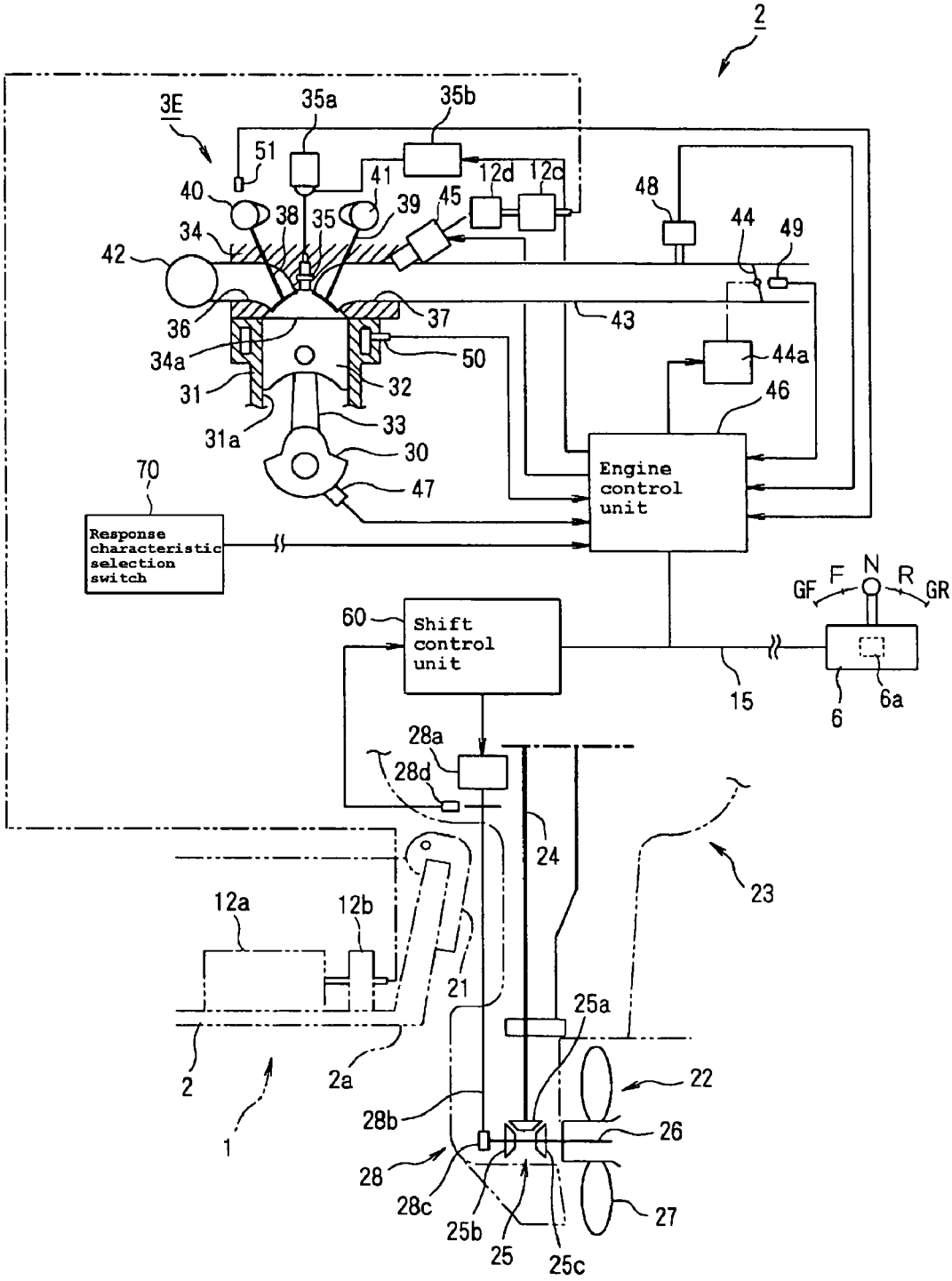
FIG. 15 is schematic illustration of a marine propulsion system and a partial sectional and schematic view of its engine, in accordance with another embodiment.

In another embodiment, the characteristic of the response of the engine speed to the operation of the remote control lever 6 can be manually adjusted. For example, a response characteristic selection switch 70 can be disposed in the vicinity of the cockpit as shown in FIG. 15, or in any other location, so as to allow a user to manually change the desired response characteristic. The selection switch 70 can be configured to allow the user to switch between any number of different response characteristics. For example, but without limitation, the selection switch 70 can be configured to allow the user to select between two, three, four, or more different response characteristics.

Figure 16:
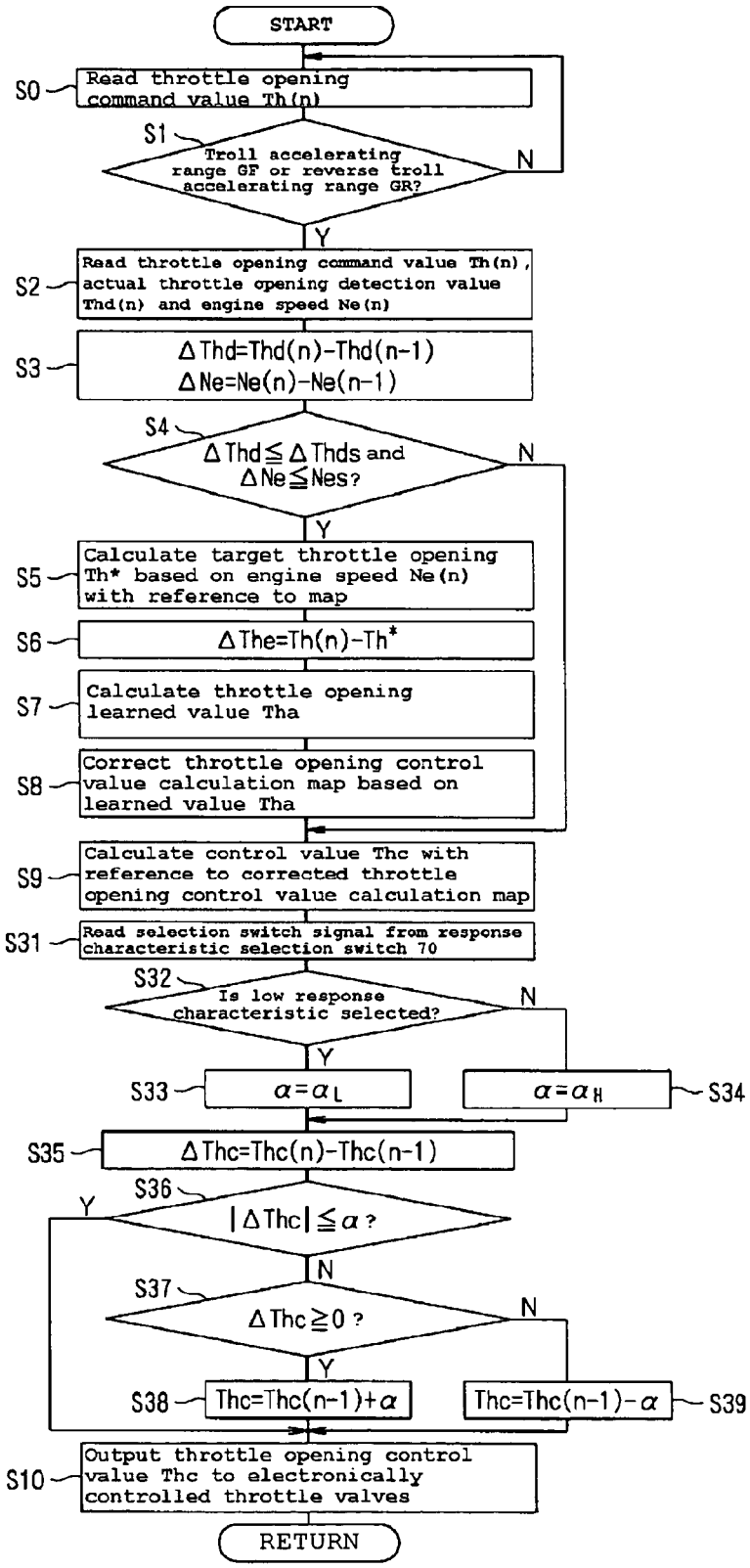
FIG. 16 is a flowchart, showing an example of a throttle opening control process which can be used with the system of FIG. 15.

A selection switch signal from the response characteristic selection switch 70 is input into the engine control unit 46. The throttle opening control process in this embodiment can be the same as the process in the first embodiment shown in FIG. 3 except that response characteristic determination process is interposed between step 9 and step 10 as shown in FIG. 16. Thus, the steps corresponding to the steps in FIG. 3 are designated by the same numerals and their detailed description is not repeated below.

The response characteristic determination process can be performed as follows. The process goes from step S9 to step S31. In step S31, a selection switch signal from the response characteristic selection switch 70 is read. Then, in step S32, it is determined whether the read selection switch signal is off, that is, represents a low response characteristic. If the selection switch signal represents a low response characteristic, a low response characteristic preset value $\alpha_L$ is set as a response characteristic preset value $\alpha$ in step S33. Then, the process goes to step S35. When the selection switch signal is on, that is, represents a high response characteristic, a high response characteristic preset value $\alpha_H$ ($>\alpha_L$) which is greater than the low response characteristic preset value $\alpha_L$ is set as the response characteristic preset value $\alpha$ in step S34. Then, the process goes to step S35.

In step S35, an amount of change ΔThc is calculated by subtracting the previous throttle opening command value Thc(n−1) from the current throttle opening command value Thc(n). Then, in step S36, it is determined whether the absolute value ΔThc of the amount of change ΔThc is not greater than the response characteristic preset value $\alpha$. If ΔThc $\alpha$, the process goes to step S10. If ΔThc>$\alpha$, the process goes to step S37, and it is determined whether the amount of change ΔThc is positive. If ΔThc 0, the process goes to step S38, and a value obtained by adding the response characteristic preset value $\alpha$ to the previous throttle opening control value Thc(n−1) is set as the current throttle opening control value Thc. Then, the process goes to step S10. If ΔThc<0, the process goes to step S39, and a value obtained by subtracting the response characteristic preset value $\alpha$ from the previous throttle opening control value Thc(n−1) is set as the current throttle opening control value Thc. Then, the process goes to step S10.

In operation, the process of FIG. 16 can perform the same as the process of FIG. 3, in that the throttle opening command value Th and the engine speed Ne are made coincident with the target throttle opening Th* by learning. When the user selects the low response characteristic with the response characteristic selection switch 70, the low response characteristic preset value $\alpha_L$ is set as the response characteristic preset value $\alpha$ in step S33, and the amount of change ΔThc between the throttle opening control value Thc(n) calculated in step S9 and the previous throttle opening control value Thc(n−1) is calculated in step S35. If the absolute value ΔThc of the amount of change ΔThc is not greater than the response characteristic preset value $\alpha$, the current throttle opening control value Thc(n) is set as the throttle opening control value Thc(n) as it is. If the absolute value ΔThc is greater then the response characteristic preset value $\alpha$ and when the throttle opening control value Thc is increasing, a value obtained by adding the response characteristic preset value $\alpha$ to the previous throttle opening control value Thc(n−1) is set as the current throttle opening control value Thc(n). The amount of increase in the throttle opening control value Thc is thereby suppressed to the low response characteristic preset value $\alpha$ or lower. Thus, even when the remote control lever 6 is operated quickly, the variation of the throttle opening control value Thc to the electronically controlled throttle valves 44 is suppressed and the variation in the engine speed Ne is suppressed. That is, a low response characteristic can be achieved.

When the user selects the high response characteristic with the response characteristic selection switch 70, a high response characteristic preset value $\alpha_H$ which is greater than the low response characteristic preset value $\alpha_L$ is set as the response characteristic preset value $\alpha$. Thus, even when the amount of change ΔThc between the previous throttle opening control value Thc(n−1) and the current throttle opening control value Thc(n) is relatively large, the current throttle opening control value Thc(n) is output to the electronically controlled throttle valves 44 as it is as long as the amount of change ΔThc is not greater than the high response characteristic preset value $\alpha_H$. Therefore, the engine speed Ne can be controlled with a high response characteristic in response to the variation in the throttle opening command value Th.

According to this embodiment, the amount of change in the throttle opening control value can be changed depending on the user's preference so that the response characteristic of the variation in the engine speed Ne determined by the operation of the remote control lever 6 can be changed.

Although a low response characteristic or a high response characteristic can be selected by the response characteristic selection switch 70 in the third embodiment, the present invention is not limited thereto. When the response characteristic selection switch 70 is configured to be able to select three or more levels of response characteristic and three of more levels of response characteristic preset values are set corresponding thereto, the response characteristic can be set more precisely.

Also, although this embodiment is applied to the first embodiment, the present invention is not limited thereto. The response characteristic determination process may be performed between steps S9 and S10 in the second embodiment.

Also, although the engine control unit 46 and the shift control unit 60 are separate from each other in the first to third embodiments, the present invention is not limited thereto. The engine control unit 46 and the shift control unit 60 may be combined into one control unit.

Further, the functions performed by the engine control unit 46, the shift control unit 60, including the functions performed in any of the steps identified in the processes of FIGS. 3, 8, 9, and 16, and any data and/or maps such as those represented by the maps of FIGS. 4–7 and 10–14 can be referred to as "modules." In the embodiments disclosed above, such modules can be in the form data tables or executable programs, routines or subroutines stored and/or run in the engine control unit 46, the shift control unit 60, or other devices.

It is to be noted that these modules, individually, collectively, or in various groupings, can be in the form of hard-wired feedback control circuits. Alternatively, these modules can be constructed of a dedicated processor and a memory for storing a computer program configured to perform the steps of the processes of FIGS. 3, 8, 9, and 16 or other processes with reference to data tables or maps of other modules. Additionally, these modules can be constructed of a general purpose computer having a general purpose processor and the memory for storing a computer program for performing the steps of the processes of FIGS. 3, 8, 9, and 16 or other processes with reference to data tables or maps of other modules.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above, but should be determined only by a fair reading of the claims that follow.

What is claimed is:

1. A control device for an engine of a boat, comprising a throttle opening command value setting module configured to set a throttle opening command value, a throttle control module configured to control a throttle valve of the engine based on a throttle opening command value set by the throttle opening command value setting module, and an engine speed detecting device configured to detect the engine speed of the engine, wherein the throttle control module is configured to learn and control the throttle opening based on the deviation of the throttle opening command value set by the throttle opening command value setting module from a target throttle opening corresponding to the engine speed detected by the engine speed detecting device.

2. The control device for an engine of a boat of claim 1, wherein the throttle control module comprises a response characteristic setting module configured to set the response characteristic of an actual throttle opening of the throttle valve depending on the throttle opening command value set by the throttle opening command value setting module, and a throttle opening target value setting module configured to set a throttle opening target value depending on the response characteristic set by the response characteristic setting module and to change a position of the throttle valve in accordance with the throttle opening target value.

3. The control device for an engine of a boat of claim 1, wherein the throttle control module comprises a throttle opening command value distribution measuring module configured to measure a frequency distribution of a throttle opening command value set by the throttle opening command value setting module, and a resolution in the throttle opening command value range which has a high frequency distribution as measured by the throttle opening command value distribution measuring module is enhanced.

4. The control device for an engine of a boat of claim 3, wherein the throttle control module comprises a response characteristic setting module configured to set the response characteristic of an actual throttle opening of the throttle valve depending on the throttle opening command value set by the throttle opening command value setting module, and a throttle opening target value setting module configured to set a throttle opening target value depending on the response characteristic set by the response characteristic setting module and to change a position of the throttle valve in accordance with the throttle opening target value.

5. A control device for an engine of a boat, comprising throttle opening command value setting means for setting a throttle opening command value, throttle control means for controlling a throttle valve of the engine based on a throttle opening command value set by the throttle opening command value setting means, and engine speed detecting means for detecting the engine speed of the engine, wherein the throttle control means learns and controls the throttle opening based on the deviation of the throttle opening command value set by the throttle opening command value setting means from a target throttle opening corresponding to the engine speed detected by the engine speed detecting means.

6. The control device for an engine of a boat of claim 5, wherein the throttle control means comprises response characteristic setting means for setting the response characteristic of the actual throttle opening of the throttle valve depending on the throttle opening command value set by the throttle opening command value setting means, and throttle opening target value setting means for setting a throttle opening target value depending on the response characteristic set by the response characteristic setting means and outputting the throttle opening target value to the throttle valve.

7. The control device for an engine of a boat of claim 5, wherein the throttle control means comprises throttle opening command value distribution measuring means for measuring the frequency distribution of the throttle opening command value set by the throttle opening command value setting means, and the resolution in the throttle opening command value range which has a high frequency distribution as measured by the throttle opening command value distribution measuring means is enhanced.

8. The control device for an engine of a boat of claim 7, wherein the throttle control means comprises response characteristic setting means for setting the response characteristic of the actual throttle opening of the throttle valve depending on the throttle opening command value set by the throttle opening command value setting means, and throttle opening target value setting means for setting a throttle opening target value depending on the response characteristic set by the response characteristic setting means and outputting the throttle opening target value to the throttle valve.

* * * * *

UNITED STATES PATENT AND TRADEMARK OFFICE

CERTIFICATE OF CORRECTION

PATENT NO. : 7,021,283 B2
APPLICATION NO. : 10/978275
DATED : April 4, 2006
INVENTOR(S) : Takashi Okuyama It is certified that error appears in the above-identified patent and that said Letters Patent is hereby corrected as shown below:

On the Title Page Item 56- at line 5, after "6,428,448" please delete "B1" and insert -- B2 --, therefor.

On the Title Page Item 56- at line 6, after "6,465,974" please delete "B1" and insert -- B2 --, therefor.

At column 1, line 4, after "119" please insert -- to --.

At column 1, line 33, please delete "than" and insert -- then --, therefor.

At column 10, line 42, please delete "FIG." and insert -- FIGS. --, therefor.

Signed and Sealed this

Twenty-ninth Day of April, 2008

JON W. DUDAS
*Director of the United States Patent and Trademark Office*